United States Patent [19]

Dyett et al.

[11] Patent Number: 4,580,939

[45] Date of Patent: Apr. 8, 1986

[54] FEEDING DEVICE FOR CIGARETTE FILTERS AND SIMILAR RODS

[75] Inventors: Derek H. Dyett, High Wycombe, England; Clifford R. Marritt; William A. Cupp, both of Richmond, Va.

[73] Assignee: Molins Machine Company Inc., England

[21] Appl. No.: 559,196

[22] Filed: Dec. 8, 1983

[30] Foreign Application Priority Data

Sep. 13, 1983 [GB] United Kingdom ..... 8323511

[51] Int. Cl.[4] ..... B65G 37/00

[52] U.S. Cl. ..... 414/198; 414/327; 414/403; 131/55; 198/347

[58] Field of Search ..... 414/323, 325, 327, 403; 198/347; 131/55, 280

[56] References Cited

U.S. PATENT DOCUMENTS

| | | | |
|---|---|---|---|
| 3,305,128 | 2/1967 | Dearsley | 414/327 X |
| 3,535,069 | 10/1970 | Molins et al. | 198/347 |
| 3,885,683 | 5/1975 | Bornfleth et al. | 414/323 X |
| 4,078,648 | 3/1978 | Hinchcliffe et al. | 198/347 |
| 4,273,233 | 6/1981 | Hinchcliffe et al. | 198/347 |
| 4,352,604 | 10/1982 | Carascon et al. | 198/347 X |
| 4,368,742 | 1/1983 | Wahle et al. | 198/347 X |
| 4,420,073 | 12/1983 | Hausler et al. | 198/347 |

FOREIGN PATENT DOCUMENTS

| | | | |
|---|---|---|---|
| 1292069 | 4/1969 | Fed. Rep. of Germany | 198/347 |

*Primary Examiner*—Joseph E. Valenza
*Assistant Examiner*—Ken Muncy
*Attorney, Agent, or Firm*—Antonelli, Terry & Wands

[57] ABSTRACT

A filter feed onto a fluted drum has conveyors which convey a stack-like stream of filters into a small reservoir adjacent to the drum. As they enter the reservoir, the filters are deflected upwards by a deflector plate so that the thrust by the conveyors does not produce a direct pressure of filters onto the drum. Instead, the filters are fed onto the drum by gravity after passing over the plate. A pivoted sensor plate over the reservoir controls the speed of the conveyors.

12 Claims, 2 Drawing Figures

FEEDING DEVICE FOR CIGARETTE FILTERS AND SIMILAR RODS

This invention is concerned with feeding filters and similar rods of the cigarette industry into flutes of a fluted drum. In particular this invention is an improvement or modification of the arrangement described in U.S. Pat. No. 4,352,604, which has the same assignee as the present application.

The above-mentioned patent describes various arrangements whereby a stack-like stream of filters is conveyed from an area below a tray unloader and is fed directly onto a fluted drum. In contrast, according to the present invention, the stack-like stream is fed into a small reservoir adjacent to the fluted drum in a manner such that the thrust of the conveyor carrying the stack-like stream does not produce a pressure of filters directly onto the drum, the filters adjacent to the drum being urged against the drum substantially entirely by gravity. The conveyor carrying the stack-like stream is preferably controlled by a pivoted plate or other sensor responding to the upper level of the filters in the small reservoir.

In a preferred construction according to this invention there is a deflector plate which deflects the stack-like stream, as it leaves the conveyor, in an upward direction into the small reservoir, the filters being able to pass over the deflector plate and then downwards towards the fluted drum under the force of gravity.

An example of a filter feed according to this invention is shown in the accompanying drawings. In these drawings.

Figure 1:
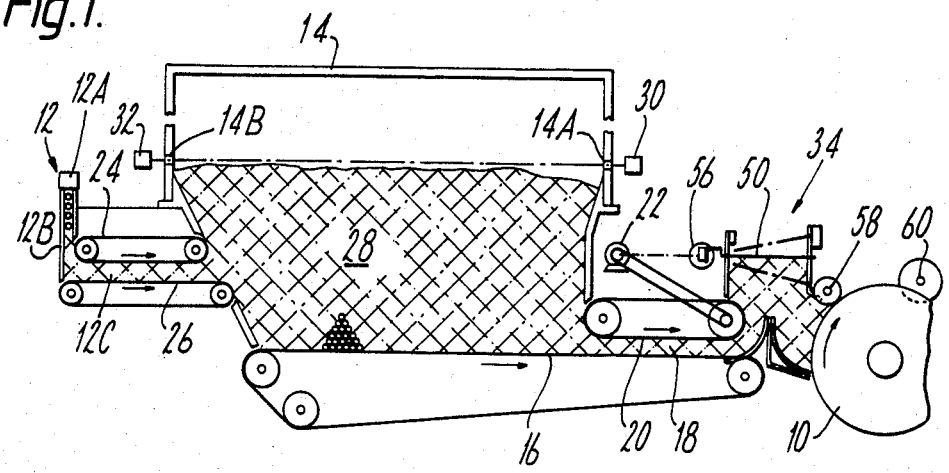
FIG. 1 is a diagrammatic front elevation of the feeding device.

The feeding device shown in FIG. 1 includes a fluted drum 10 to which filter rods are fed either from a receiver unit 12 of a pneumatic feeding device, or from a succession of trays 14 at a tray unload area. A horizontal conveyor 16 formed by two laterally spaced parallel bands extends below the tray and is arranged to carry a multi-layer stream 18 of rods towards the fluted drum 10 with the aid of an upper conveyor band 20 confining the upper surface of the stream 18. The conveyors 16 and 20 are coupled together by a chain or gear drive so as to move at the same speed, both being driven by a motor 22 controlled in a manner described below.

During normal operation of the device, filters are received pneumatically by the receiver 12 at an entry location 12A, and then drop through a channel 12B to form a multi-layer stream 12C which is conveyed horizontally to the right by upper and lower conveyor bands 24 and 26. The stream 12C thus enters a space 28 within the tray unload area. FIG. 1 shows a substantially empty tray 14 of which the interior forms a vertical extension of the space 28 and serves as a buffer zone for pneumatically fed filters.

Adjacent to the tray there is a fixed light source 30 which directs a horizontial beam of light through an aperture 14A in the adjacent wall of the tray. Assuming that the level of rods lies below the beam, the beam continues through an aperture 14B in the opposite side wall of the tray and impinges upon a light detector 32. As long as the beam of light passes through the tray in that way, a pneumatic filter delivery device (not shown) is provided with a demand signal whereby filter rods are delivered to the receiver 12. Whenever the filter rods rise in the space 28 so as to interrupt the beam of light, the pneumatic delivery of filter rods ceases temporarily. Thus a substantially predetermined quantity of filter rods is maintained in the area 28 as long as the pneumatic filter feed is in operation.

In the event of the pneumatic filter feed ceasing to operate, the empty tray 14 will be replaced by a succession of full trays containing filter rods so as to maintain the supply of filter rods to the fluted drum 10.

Figure 2:
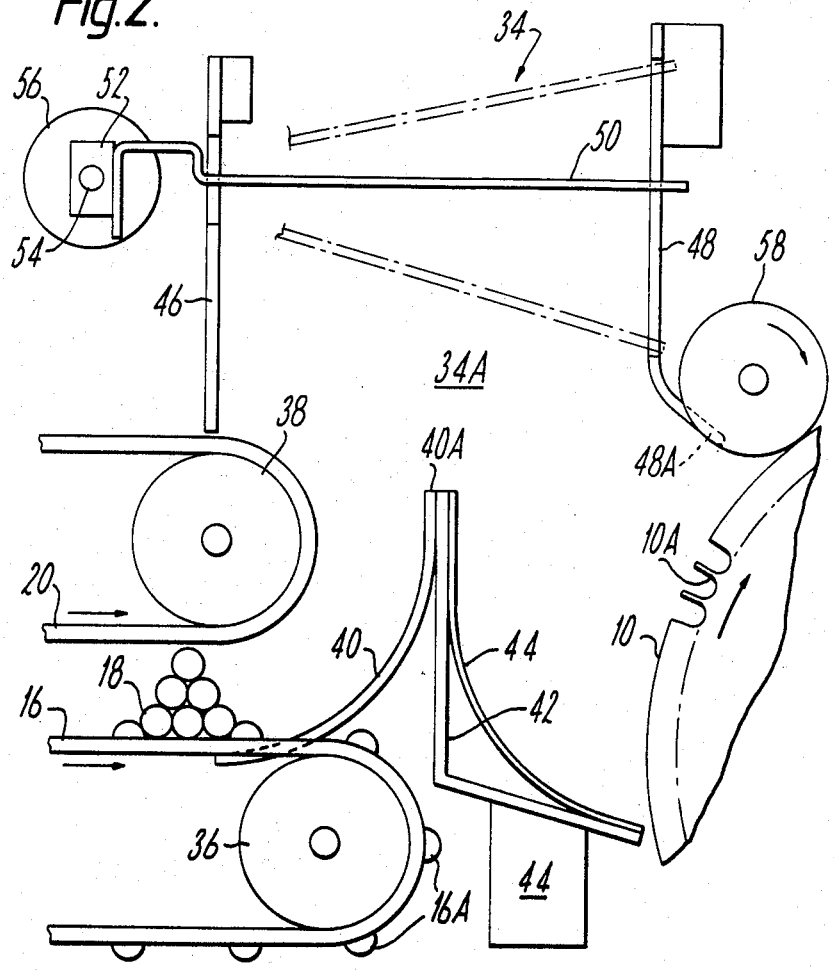
FIG. 2 is a enlarged view of part of the feeding device shown in FIG. 1.

FIG. 2 shows in greater detail the construction of the feed device in the region of the fluted drum 10. In particular, FIG. 2 shows the construction of a small or secondary reservoir 34 which is generally referenced in FIG. 1.

As shown in FIG. 2, the stream 18 of filter rods conveyed between conveyors 16 and 20 comprises approximately three layers. The parallel bands forming the conveyor 16 each have transverse ribs 16A whereby the filter rods are positively driven. At their downstream ends the conveyors 16 and 20 return around pulleys 36 and 38, the pulley 38 being slightly to the left of pulley 36.

Above the pulley 36 there is a concave deflector plate 40 which is mounted at its upper end 40A on a bracket 42 secured to a fixed member 44 mounted on the machine frame. The lower end of the plate 40 is of reduced width so that it can extend between the parallel bands forming the conveyor 16. Thus the plate 40 lifts the rod stream 18 off the conveyor 16 and then guides it along a curved path centered around the axis of the pulley 38. For that purpose the plate 40 is a concave shape centered on the same axis. Thus the stream 18 is directed upwards, substantially vertically, into a space 34A within the reservoir. It should be noted that the upward path of the stream as it enters the reservoir is spaced from the fluted drum 10 so that the thrust imparted to the stream by the conveyor 16, 20 does not produce a pressure of rods directly onto the fluted drum. Instead, after passing over the upper end 40A of the deflector plate 40, the rods pass downwards under gravity towards a side portion of the fluted drum 10. During such latter movement, the filters slide along a concave guide plate 44 which is also secured to the bracket 42.

It will be seen that the lower end of the guide plate 44 lies below the level of the axis of the fluted drum. Alternatively, the lower end of the plate 44 could be at substantially the same height as the drum axis.

Side walls of the reservoir 34 are formed by fixed vertical plates 46 and 48. These have central vertical slots extending from their upper ends through which a sensor plate 50 projects in order to rest upon the rods in the reservoir. The plate 50 is mounted at its left-hand end on a block 52 connected to a spindle 54 which in turn is connected to the rotary part of a rotary potentiometer 56. The mean horizontial position of the plate 50 is shown in solid outline, upper and lower limiting positions of the plate being shown in broken outline. Thus it will be understood that sensor plate 50 detects the height or volume of rods in the reservoir and determines the angular position of the spindle 54 which in turn produces a variable output or signal controlling the motor 22. The conveyor 16, 20 is thus driven at a variable speed so as to maintain substantially constant the volume or height of filters in the reservoir.

A lower end portion 48A of the side wall 48 is bent towards a refuser roller 58 and is of reduced width so as to enter a circumferential groove in the roller. The roller 58 rotates in a clockwise direction and ensures that any rods that are not firmly seated in flutes 10A of the fluted drum 10 are driven back into the reservoir.

As described in the above-mentioned patent, the filter rods carried by the fluted drum are cut into two or more portions by one or more knives 60 to form double filter portions which are subsequently joined to cigarettes in any well known manner.

As an alternative to use of a rotary potentiometer, the plate 50 may be freely pivotable and its height may be sensed by an optical or other transducer or by a switch whereby the motor 22 is switched on and off depending upon the height of the sensor plate. Alternatively, the plate 22 may be omitted, and the height of the filter rods in the reservoir area may be detected by a light beam in the same manner as described with reference to the tray unload area.

We claim:

1. A device for feeding filter rods, comprising conveyor means for conveying a stream of filter rods from a supply of filter rods and towards a fluted drum, means defining a space adjacent to the fluted drum from which filter rods can enter the flutes of the drum, and fixed deflector means disposed between said conveyor means and said fluted drum and beneath said space for substantially dissipating the thrust imparted to the stream by the conveyor means, including a concave deflector plate arranged to deflect the stream of filter rods from the conveyor means substantially vertically upwards and into said space in an upward direction at a position adjacent said fluted drum, so that filter rods which move toward said space and over said concave deflector plate are allowed to move toward the fluted drum substantially only under the force of gravity.

2. A device according to claim 1, wherein said space comprising a buffer reservoir, and including means for detecting the height or volume of filter rods in the reservoir and for controlling the conveyor means in response thereto.

3. A device according to claim 2, in which the detecting means comprises a pivoted plate resting on the filter rods in the reservoir.

4. A device according to claim 3, in which the pivotal mounting for the plate comprises a spindle which carries the plate and is connected to a rotary regulator for controlling the speed of the conveyor means.

5. A device, for feeding filter rods, comprising means defining a tray unload area for unloading filter rods from a succession of trays, conveyor means extending below the tray unload area for conveying a stream of filter rods from the tray unload area and towards a fluted drum, means defining an expansion space adjacent to the fluted drum from which filter rods can enter the flutes of the drum, and fixed deflector means arranged beneath said expansion space for deflecting the stream of filter rods from the conveyor means and into said expansion space in an upward direction to substantially dissipate the thrust imparted to the stream by the conveyor means, in which the conveyor means comprises a lower conveyor extending below the tray unload area and a parallel upper conveyor band which defines the upper surface of the stream and returns around a pulley at its downstream end, the deflector means comprising a concave deflector plate having a center of curvature substantially on the axis of the said pulley at a position adjacent said fluted drum, so that filter rods which move toward said space and over said concave deflector plate are allowed to move toward the fluted drum substantially only under the force of gravity.

6. A device according to claim 5, wherein said expansion space comprises a buffer reservoir, and in which a lower wall of the reservoir is formed by a rod guide plate extending downwards towards a side of the fluted drum from a position adjacent to the upper end of the deflector means.

7. A device according to claim 5, including means for receiving pneumatically conveyed filter rods, and means for delivering a stream of filter rods from the said receiving means and into the tray unload area from a side of the tray unload area remote from the fluted drum, the space within an empty tray at the tray unload area serving as a buffer space for filter rods delivered pneumatically via the said receiving means.

8. A device for feeding filter rods, comprising means defining a tray unload area for unloading filter rods from a succession of trays, conveyor means extending below the tray unload area for conveying a stream of filter rods from the tray unload area and towards a fluted drum, means defining an expansion space adjacent to the fluted drum from which filter rods can enter the flutes of the drum at a plurality of positions at the surface of the drum, and means substantially below said expansion space for directing the stream of filter rods from the conveyor means and into said expansion space in a substantially vertically upward direction along a path spaced from the fluted drum whereby the thrust imparted to the stream by the conveyor means is substantially dissipated during entry of the rods into said expansion space, and the rods thereafter move towards the fluted drum from said expansion space substantially only under the force of gravity.

9. A device for feeding filter rods, comprising means defining a tray unload area for unloading filter rods from a succession of trays, conveyor means extending below the tray unload area for conveying a stream of filter rods from the tray unload area and towards a fluted drum, means defining a reservoir adjacent to the fluted drum from which filter rods can enter the flutes of the drum, and fixed deflector means including a concave deflector plate for deflecting the stream of filter rods from the conveyor means substantially vertically upwards and into a lower portion of said reservoir in an upward direction, so that filter rods carried by said conveyor means pass into said reservoir and then pass from said reservoir to said fluted drum, whereby the thrust imparted to the stream by the conveyor means is substantially dissipated during entry of the rods into the reservoir and the rods thereafter move toward the fluted drum from the reservoir substantially only under the force of gravity.

10. A device according to claim 9, including means for detecting the height or volume of filter rods in the reservoir and for controlling the speed of said conveyor means in response thereto.

11. A device according to claim 9, in which the conveyor means comprises a lower conveyor extending below the tray unload area and a parallel upper conveyor band which defines the upper surface of the stream and returns around a pulley at its downstream end, the concave deflector plate having a center of curvature which is centered substantially on the axis of the said pulley.

12. A device according to claim 9, including means for receiving pneumatically conveyed filter rods, and means for delivering a stream of filter rods from the said receiving means and into the tray unload area from a side of the tray unload area remote from the fluted drum, the space within an empty tray at the tray unload area serving as a buffer space for filter rods delivered pneumatically via said receiving means.

* * * * *